US011340542B2

(12) United States Patent
Yokoyama

(10) Patent No.: US 11,340,542 B2
(45) Date of Patent: May 24, 2022

(54) FIXING DEVICE AND IMAGE FORMING APPARATUS

(71) Applicant: TOSHIBA TEC KABUSHIKI KAISHA, Tokyo (JP)

(72) Inventor: Shuji Yokoyama, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/039,706

(22) Filed: Sep. 30, 2020

(65) Prior Publication Data

US 2021/0080883 A1 Mar. 18, 2021

Related U.S. Application Data

(63) Continuation of application No. 16/575,169, filed on Sep. 18, 2019, now Pat. No. 10,824,099.

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 9,864,312 B1 * 1/2018 Okano ..... G03G 15/2039
2013/0164055 A1 * 6/2013 Tokuhiro ..... G03G 15/2046 399/329
2017/0045849 A1 * 2/2017 Saiki ..... G03G 15/2053

FOREIGN PATENT DOCUMENTS

JP 2018-146752 A2 9/2018

OTHER PUBLICATIONS

Non-Final Office Action on U.S. Appl. No. 16/575,169 dated Mar. 3, 2020.
Notice of Allowance on U.S. Appl. No. 16/575,169 dated Jun. 29, 2020.

* cited by examiner

*Primary Examiner* — Clayton E. LaBalle
*Assistant Examiner* — Michael A Harrison
(74) *Attorney, Agent, or Firm* — Foley & Lardner LLP

(57) ABSTRACT

A fixing device that fixes a toner image to a medium, includes: a heating body rotatably supported; an auxiliary heating member disposed along an inner surface of the heating rotation body; a temperature sensor facing the inner surface via the auxiliary heating member; a first elastic body configured to press, via a first force, the temperature sensor against the inner surface; and a second elastic body configured to press, via a second force, a sliding member against the inner surface. A product of a distance from a center of the auxiliary heating member to the first elastic body and the first elastic force is equal to a product of a distance from the center to the second elastic body and the second elastic force.

18 Claims, 13 Drawing Sheets

FIXING DEVICE AND IMAGE FORMING APPARATUS

CROSS-REFERENCE TO RELATED APPLICATION

This application is a continuation of U.S. application Ser. No. 16/575,169, filed Sep. 18, 2019, the entire contents of which are incorporated herein by reference.

FIELD

Embodiments described herein relate generally to a fixing device and an image forming apparatus.

BACKGROUND

An image forming apparatus such as a multifunction peripheral or a laser printer is provided with a fixing device for fixing a toner image on paper. The fixing device fixes a toner image transferred to the paper by transferring the heat of a heater to the paper via, for example, a fixing belt. Accordingly, the printing of an image, characters and the like on paper is realized.

A fixing device is provided with a sensor for detecting the temperature of a fixing belt and a thermostat for suppressing overheating of the fixing belt. These sensors are disposed to face the inner peripheral surface of the fixing belt. For example, in a heating device with an induction heating (IH) coil as the heat source, the sensor is pressed against the inner peripheral surface of a fixing belt via a magnetic shunt member or the like.

When a sensor is pressed against a fixing belt via a magnetic shunt member, if the sensor is not disposed at the center of the magnetic shunt member, a rotational moment may be generated in the magnetic shunt member. As such, the position and posture of the magnetic shunt member relative to the fixing belt may be changed, which may negatively affect the accuracy of the sensor. However, when a plurality of types of sensors are required to be arranged on a fixing belt, or when a sensor is disposed at the position where a fixing belt becomes hot, it is difficult to arrange the sensor at the center of the fixing belt in some cases.

DETAILED DESCRIPTION

In general, according to one embodiment, a fixing device that fixes a toner image formed to a medium, includes: a heating body rotatably supported; an auxiliary heating member disposed along a portion of an inner surface of the heating body; a temperature sensor facing the portion of the inner surface of the heating rotation body with the auxiliary heating member disposed between the temperature sensor and the portion of the inner surface of the heating body; a first elastic body configured to provide a first elastic force to press the temperature sensor toward the portion of the inner surface of the heating body; and a second elastic body, separated from the first elastic body, configured to sandwich a center of the auxiliary heating member with respect to the temperature sensor in a longitudinal direction of the heating rotation body and provide a second elastic force to press a sliding member against the portion of the inner surface of the heating body. A product of a first distance from the center of the auxiliary heating member to the first elastic body and the first elastic force is equal to a product of a second distance from the center of the auxiliary heating member to the second elastic body and the second elastic force.

Hereinafter, an image forming apparatus according to an embodiment will be described with reference to the drawings. In the description, an XYZ coordinate system consisting of mutually orthogonal X, Y, and Z axes is used as appropriate.

Figure 1:
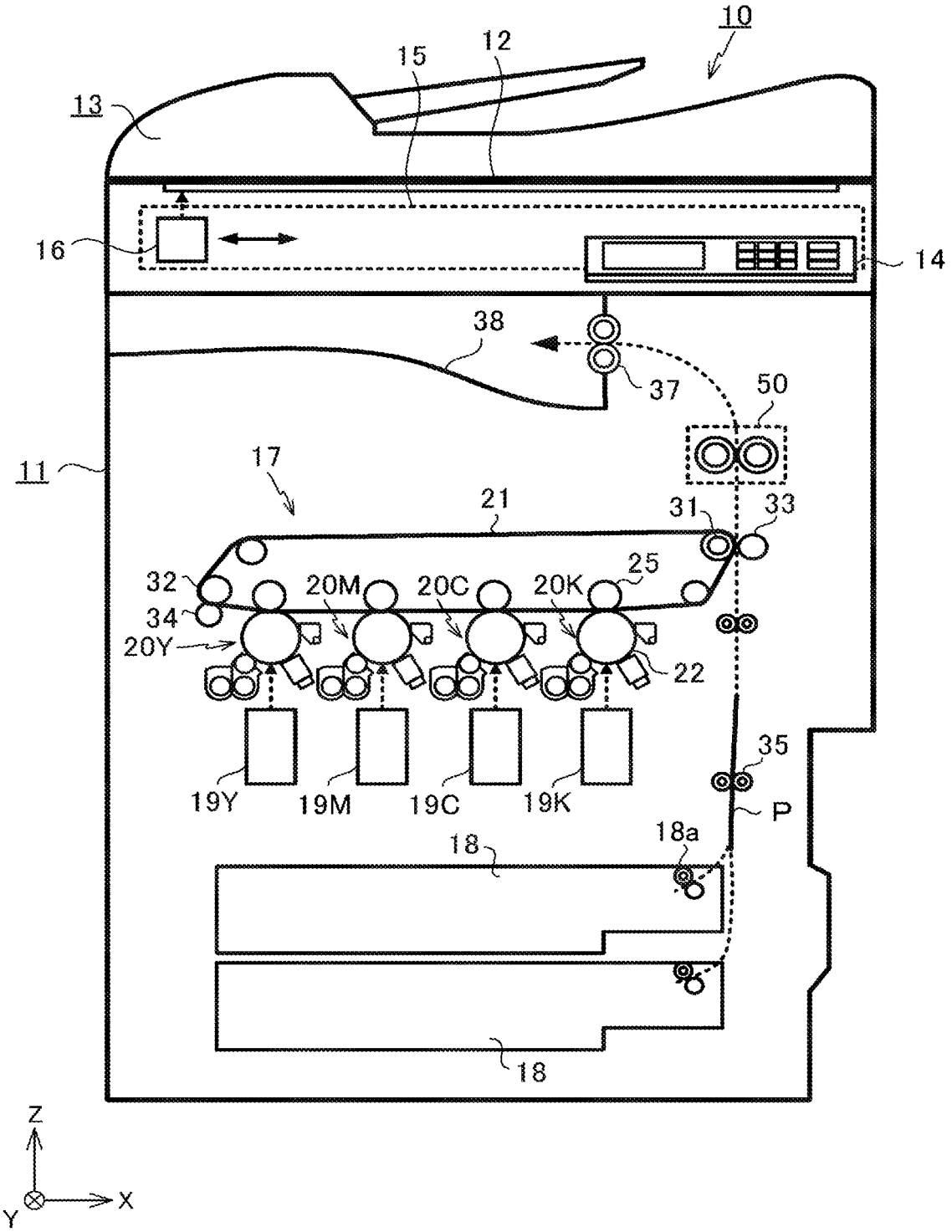
FIG. 1 is schematically showing a configuration of an image forming apparatus according to an embodiment.

FIG. 1 is a view schematically showing the configuration of an image forming apparatus 10 according to an embodiment. The image forming apparatus 10 is, for example, a multi-function peripheral (MFP). The image forming apparatus 10 includes a main body 11 and an automatic document feeder (ADF) 13 disposed above the main body 11. A document table 12 made of transparent glass is disposed in the upper side of the main body 11, and the automatic document feeder (ADF) 13 is provided on the upper surface side of the document table 12 to be able to rise and fall down. Further, an operation panel 14 is provided on the upper side of the main body portion 11. The operation panel 14 has various keys, a graphical user interface (GUI), and the like.

In the lower side of the document table 12, a scanner 15 for reading an original document is provided. The scanner 15 reads an original document fed by the automatic document feeder 13 or an original document placed on the document table 12 to generate image data. The scanner 15 is provided with an image sensor 16.

When reading an image of an original document placed on the document table 12, the image sensor 16 reads an image of the original document while moving in the +X direction along the document table 12. Further, when reading an image of the original document supplied to the document table 12 by the automatic document feeder 13, the image sensor 16 is fixed at the position shown in FIG. 1 and reads each image of the sequentially fed original document.

An image forming unit 17 is disposed inside the main body unit 11. The image forming unit 17 forms a toner image on a recording medium such as paper accommodated in a paper feeding cassette 18 based on image data read by the scanner 15 or image data generated by a personal computer or the like.

The image forming unit 17 includes image forming units 20Y, 20M, 20C, and 20K that form a latent image using toners of yellow (Y), magenta (M), cyan (C), and black (K), scanning heads 19Y, 19M, 19C, and 19K provided corresponding to the image forming units, an intermediate transfer belt 21 and the like.

The image forming units 20Y, 20M, 20C, and 20K are disposed below the intermediate transfer belt 21. In the image forming unit 17, the image forming units 20Y, 20M, 20C, and 20K are arranged from the −X side to the +X side. The scanning heads 19Y, 19M, 19C and 19K are disposed below the image forming units 20Y, 20M, 20C and 20K, respectively.

Figure 2:
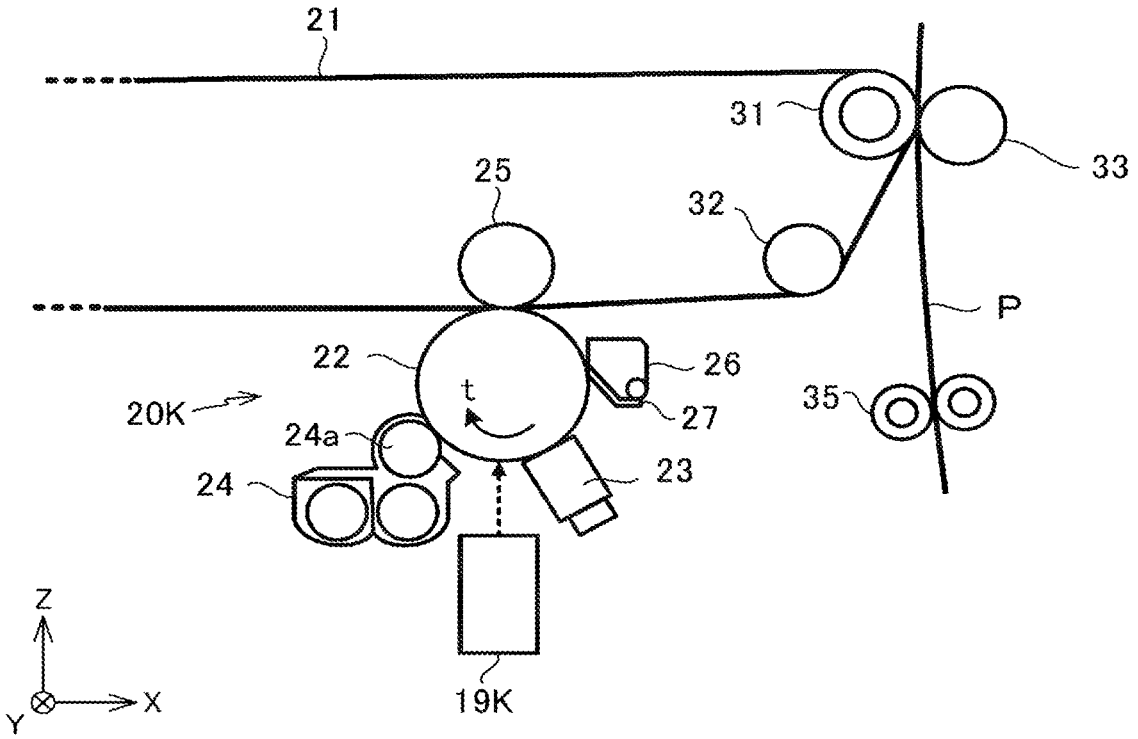
FIG. 2 is an enlarged view showing an image forming unit.

FIG. 2 is an enlarged view showing the image forming unit 20K among the image forming units 20Y, 20M, 20C, and 20K. The image forming units 20Y, 20M, 20C, and 20K have the same configuration. Therefore, the configuration of each image forming unit will be described using the image forming unit 20K as an example.

The image forming unit 20K includes a photosensitive drum 22 which is an image holding member. Around the photosensitive drum 22, an electrostatic charger 23, a developer 24, a primary transfer roller 25, a cleaner 26, and the like are disposed in the direction indicated by the arrow t. Laser light is emitted from the scanning head 19K to the exposure position of the photosensitive drum 22. An electrostatic latent image is formed on the surface of the photosensitive drum 22 by irradiating the surface of the rotating photosensitive drum 22 with the laser light.

The electrostatic charger 23 of the image forming unit 20K uniformly charges the surface of the photosensitive drum 22. The developer 24 supplies the toner to the photosensitive drum 22 by a developing roller 24*a* to which a developing bias is applied, and develops the electrostatic latent image. The cleaner 26 peels off the residual toner on the surface of the photosensitive drum 22 using a blade 27. The toner separated by the blade 27 is collected by the cleaner 26.

As shown in FIG. 1, the intermediate transfer belt 21 is stretched around a driving roller 31 and three driven rollers 32. The intermediate transfer belt 21 rotates counterclockwise in FIG. 1 as the driving roller 31 rotates. Further, the intermediate transfer belt 21 is in contact with the upper surfaces of the respective photosensitive drums 22 of the image forming units 20Y, 20M, 20C, and 20K. A primary transfer voltage is applied by the primary transfer roller 25 to the position of the intermediate transfer belt 21 facing the photosensitive drum 22. Thus, the toner image developed on the surface of the photosensitive drum 22 is primarily transferred onto the rotating intermediate transfer belt 21.

A secondary transfer roller 33 is disposed to face the driving roller 31 that stretches the intermediate transfer belt 21. When paper P passes between the driving roller 31 and the secondary transfer roller 33, a secondary transfer voltage is applied to the paper P by the secondary transfer roller 33. Thus, the toner image formed on the intermediate transfer belt 21 is secondarily transferred to the paper P. In the vicinity of the driven rollers 32 of the intermediate transfer belt 21, a belt cleaner 34 is provided. The belt cleaner 34 removes the residual toner on the surface of the intermediate transfer belt 21.

A paper feeding roller 35 is provided between the paper feeding cassette 18 and the secondary transfer roller 33. The paper P taken out from the paper feeding cassette 18 by a pickup roller 18*a* disposed in the vicinity of the paper feeding cassette 18 is conveyed by the paper feeding roller 35 between the intermediate transfer belt 21 and the secondary transfer roller 33.

A fixing device 50 is provided above the secondary transfer roller 33. In addition, a paper discharge roller 37 is provided above the fixing device 50. The paper P which passed the intermediate transfer belt 21 and the secondary transfer roller 33 is heated by the fixing device 50. Thus, the toner image is fixed to the paper P. The paper P passed through the fixing device 50 is discharged to a paper discharge unit 38 by the paper discharge roller 37.

Figure 3:
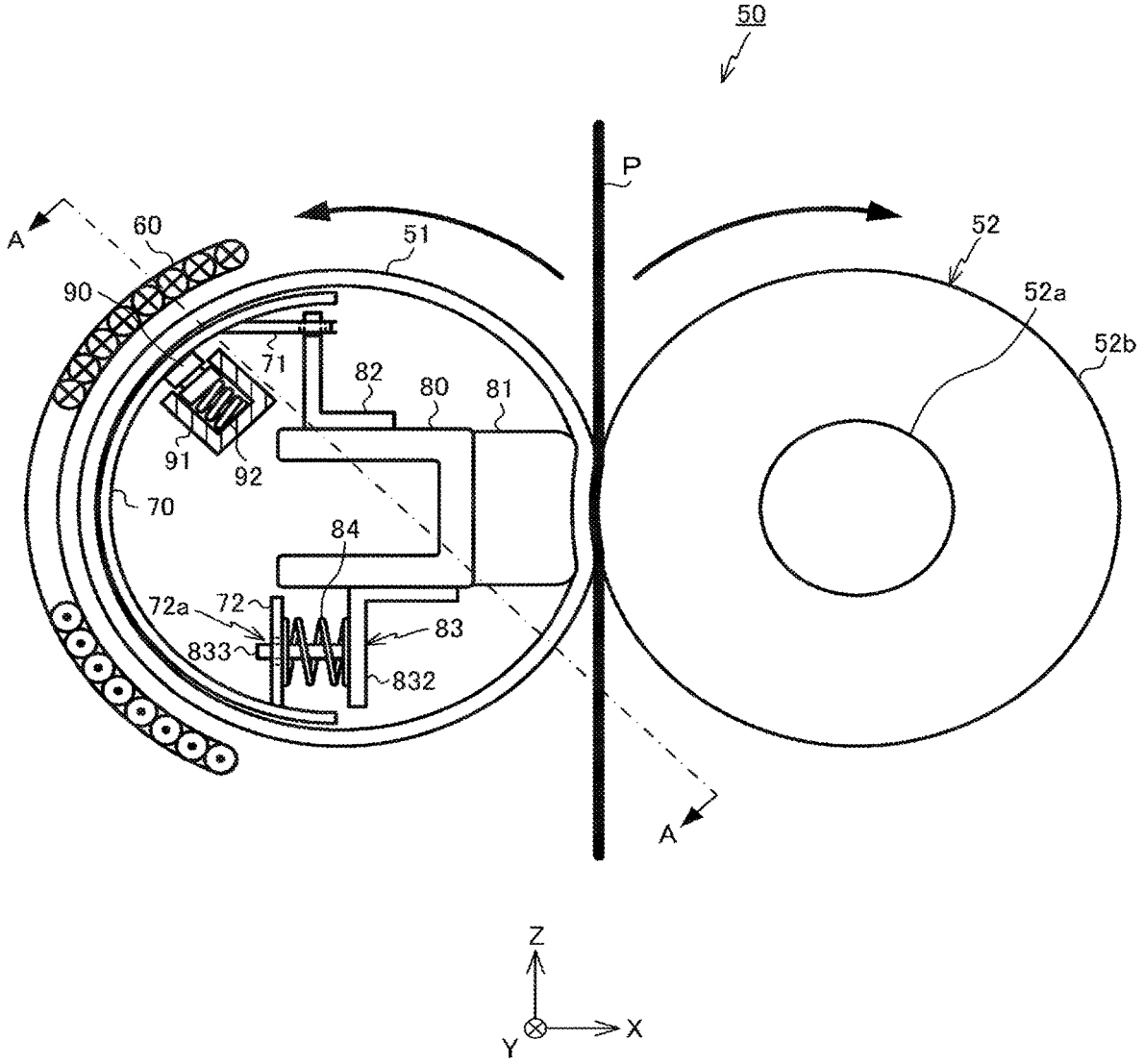
FIG. 3 is a schematic view of a fixing device.
Figure 4:
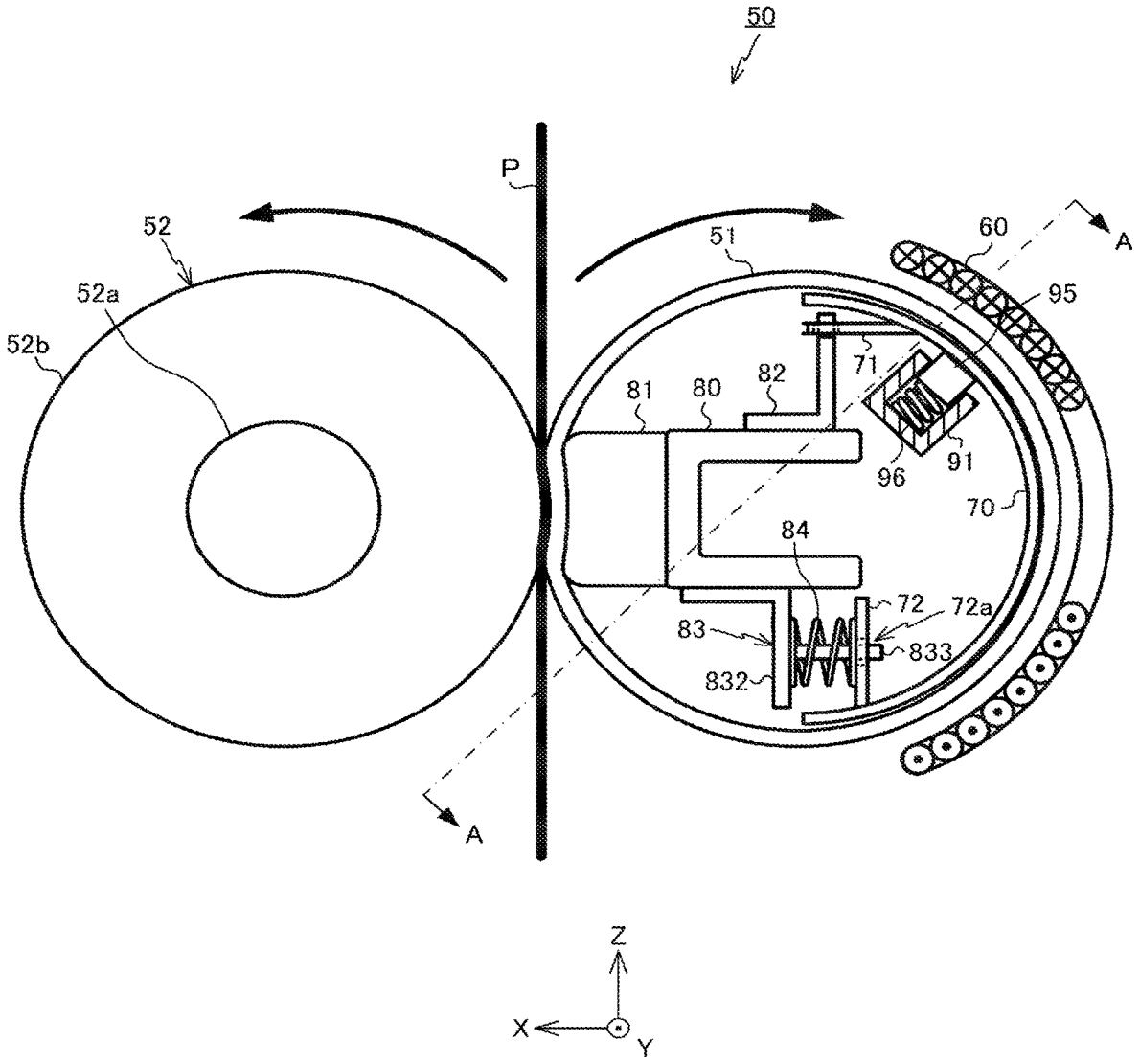
FIG. 4 is a schematic view of the fixing device.

FIG. 3 is a schematic view when the fixing device 50 is viewed from the −Y side. FIG. 4 is a schematic view of the fixing device 50 as viewed from the +Y side. The fixing device 50 includes a fixing belt (a heating body, or a cylindrical heating rotation body) 51, a pressure roller 52, a base member 80 disposed inside the fixing belt 51, a pressure pad 81 supported by the base member 80, a magnetic shunt member 70 as an auxiliary heating member, a heating coil 60 disposed along the outer peripheral surface of the fixing belt 51, a thermostat (temperature sensor) 90 (see FIG. 3), a sliding member 95 (see FIG. 4) and the like.

The fixing belt 51 is a cylindrically shaped member whose longitudinal direction is the Y-axis direction, and the length thereof is larger than the width of the paper P (dimension in the Y-axis direction). The thickness of the fixing belt 51 is about 300 μm. The fixing belt 51 uses, for example, a film having heat resistance and a thickness of 70 μm and made of polyimide as a base material. On the surface of the base material, for example, a heat generating layer, a multi-functional layer, an elastic layer, and a protective layer are laminated.

The heat generating layer is a layer made of copper, and the multi-functional layer is a layer made of nickel. The elastic layer is a layer made of silicon rubber having a thickness of about 200 μm. This elastic layer is covered with a protective layer made of PFA resin (perfluoroalkoxy fluorine resin) or the like. The fixing belt 51 is rotatably supported around an axis parallel to the Y axis. The inner peripheral surface of the fixing belt 51 is coated with silicone oil as a lubricant.

The base member 80 is a member having a longitudinal direction as the Y-axis direction and a U-shaped XZ cross-section. The base member 80 has substantially the same length as the fixing belt 51 and is horizontally supported so as to be parallel to the Y axis.

The pressure pad 81 is a member whose longitudinal direction is the Y-axis direction. The pressure pad 81 is made of, for example, polyphenylene sulfide resin (PPS), liquid crystal polymer (LCP), phenol resin (PF) or the like. A contact surface (surface on the +X side) of the pressure pad 81 is a curved surface that is curved along the side surface of the pressure roller 52. For example, a sheet or the like having excellent slidability and wear resistance is attached to the contact surface of the pressure pad 81, if necessary. A sheet of this type is made of, for example, glass cloth. When the material of the sheet has a mesh structure like glass cloth, a lubricant is held by the mesh, and thus the frictional resistance between the pressure pad 81 and the fixing belt 51 can be reduced.

Figure 5:
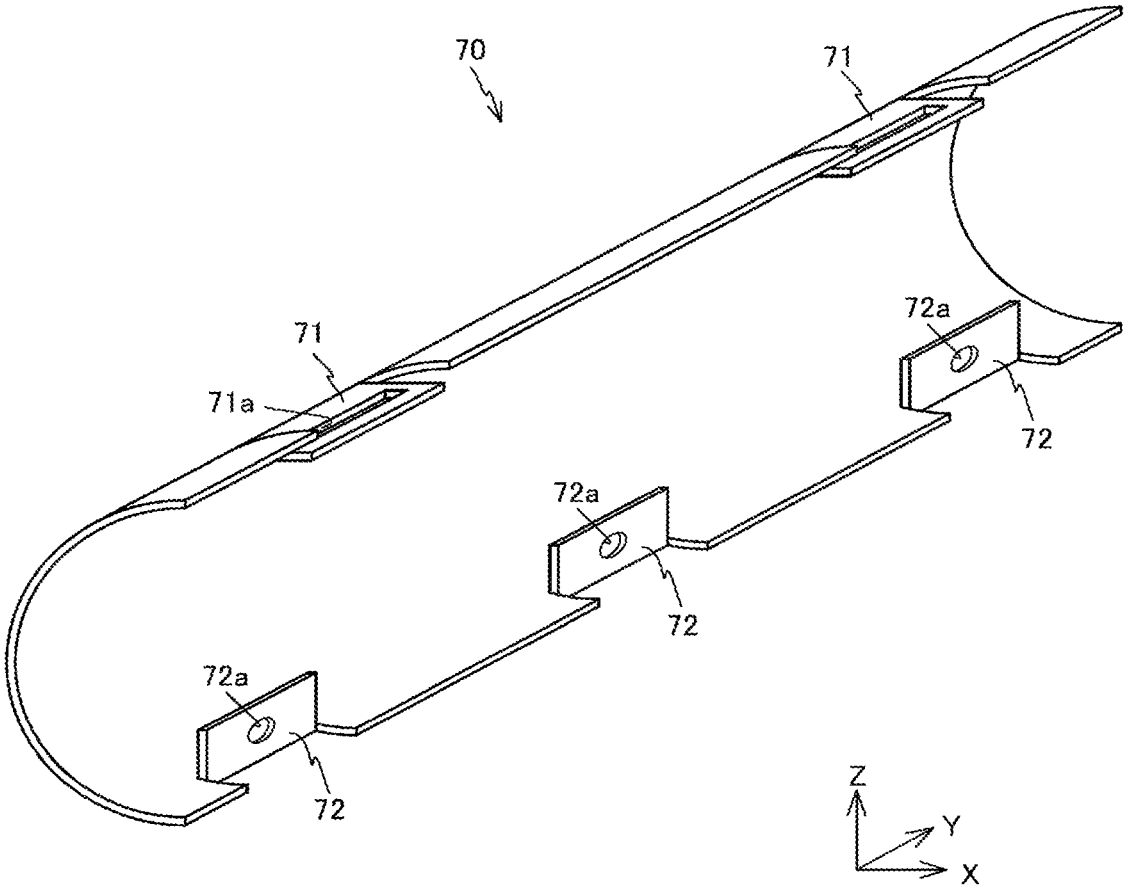
FIG. 5 is a perspective view of a magnetic shunt member.

FIG. 5 is a perspective view of the magnetic shunt member 70. The magnetic shunt member 70 is a member whose longitudinal direction is the Y-axis direction. The magnetic shunt member 70 is shaped in a semi-cylindrical shape. The magnetic shunt member 70 is made of a magnetic shunt alloy whose magnetic permeability varies depending on temperature. The magnetic shunt member 70 has a property that the magnetism changes when the member is heated to the Curie temperature or higher. The Curie temperature of the magnetic shunt member 70 is approximately 200° C. although the Curie temperature varies depending on the application of the image forming apparatus 10 and the like. The magnetic shunt member 70 is made of, for example, an alloy of iron and nickel.

As shown in FIG. 5, for example, a pair of fixing portions 71 are formed at the upper end portion of the magnetic shunt member 70. Each of the pair of fixing portions 71 has a rectangular shape whose longitudinal direction is the Y-axis direction, and is provided parallel to the XY plane. At the center of each of the fixing portions 71, a rectangular opening 71*a* whose longitudinal direction is the Y-axis direction is formed. Further, at the lower end portion of the magnetic shunt member 70, for example, three contact portions 72 are formed at equal intervals in the Y-axis direction. Each of the contact portions 72 has a rectangular shape whose longitudinal direction is the Y-axis direction, and is provided parallel to the YZ plane. Further, at the center of the contact portion 72, an opening 72*a* penetrating in the X-axis direction is provided. The magnetic shunt member 70 provided with the fixing portions 71 and the contact portion 72 can be integrally formed by, for example, sheet-processing a magnetic shunt alloy.

In the magnetic shunt member 70, the surface in contact with the fixing belt 51 is subjected to treatment for reducing friction. This treatment may be, for example, DLC (Diamond-Like Carbon) coating treatment, CrN coating treatment, Sn plating treatment, or the like.

Figure 6:
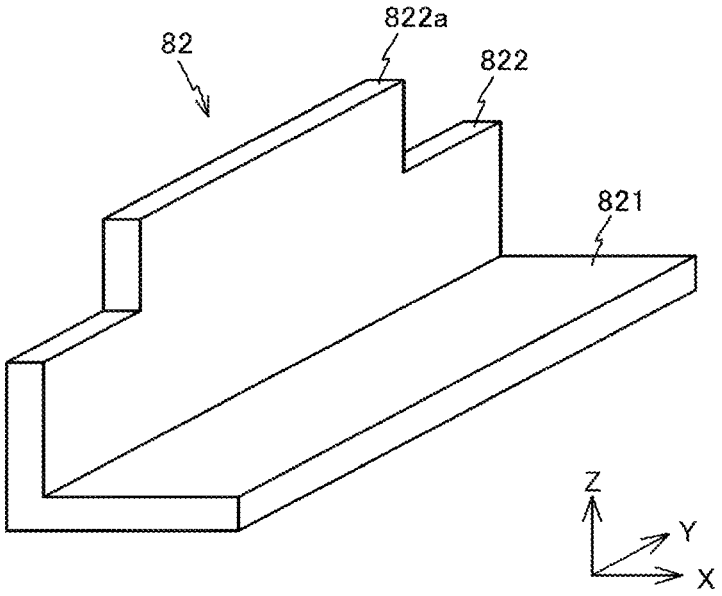
FIG. 6 is a perspective view of a support member.

The magnetic shunt member 70 is pivotally supported by a support member 82 as shown in FIG. 3. FIG. 6 is a perspective view of the support member 82. As shown in FIG. 6, the support member 82 is a member having an L-shaped XZ cross-section. The support member 82 is formed of, for example, an iron or stainless steel plate, and includes two parts of a fixing portion 821 parallel to the XY plane and a support portion 822 parallel to the YZ plane. At the upper end portion of the support portion 822, a protruding portion 822*a* having a width in the Y-axis direction smaller than that of the support portion 822 is formed. The support member 82 is attached to the base member 80 by fixing the fixing portion 821 to the upper surface of the base member 80.

Figure 7:
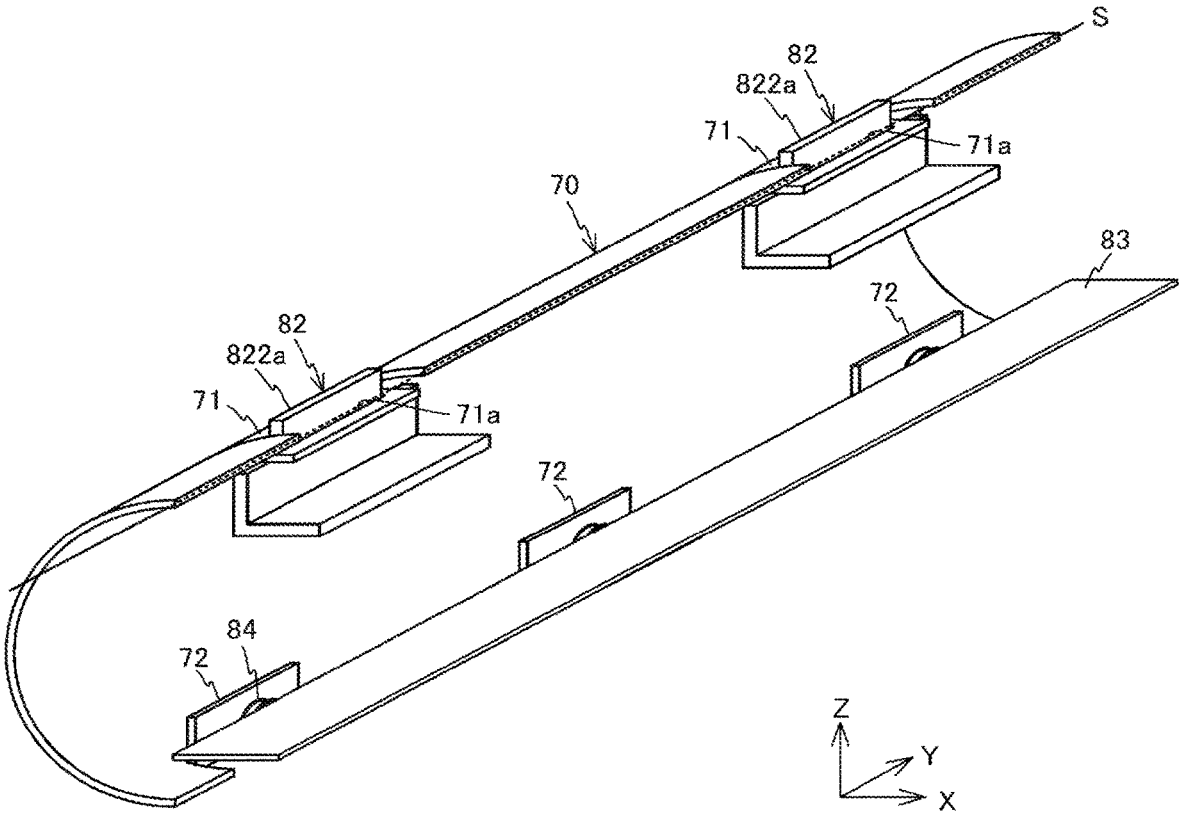
FIG. 7 is a view showing a magnetic shunt member supported by the support member.

FIG. 7 is a view showing the magnetic shunt member 70 supported by the support member 82. As shown in FIG. 7, the magnetic shunt member 70 is supported by the support member 82 in a state where the protruding portion 822*a* of the support member 82 is inserted into the opening 71*a* of the fixing portion 71. The thickness of the protruding portion 822*a* of the support member 82 is smaller than the width (the size in the X-axis direction) of the opening 71*a* of the magnetic shunt member 70. Therefore, the magnetic shunt member 70 oscillates about the opening 71*a* in a state where the position in the YX plane is defined by the protruding portion 822*a*. Since the magnetic shunt member 70 is supported by the support member 82 separated in the Y-axis direction, the magnetic shunt member can oscillate about a virtual axis S parallel to the inner peripheral surface of the fixing belt 51.

As shown in FIG. 3, the magnetic shunt member 70 is in contact with the inner peripheral surface of the fixing belt 51 by biasing the contact portion 72 in the −X direction by a spring 84. The spring 84 is a push spring and is supported by a support plate 83 fixed to the lower surface of the base member 80.

Figure 8:
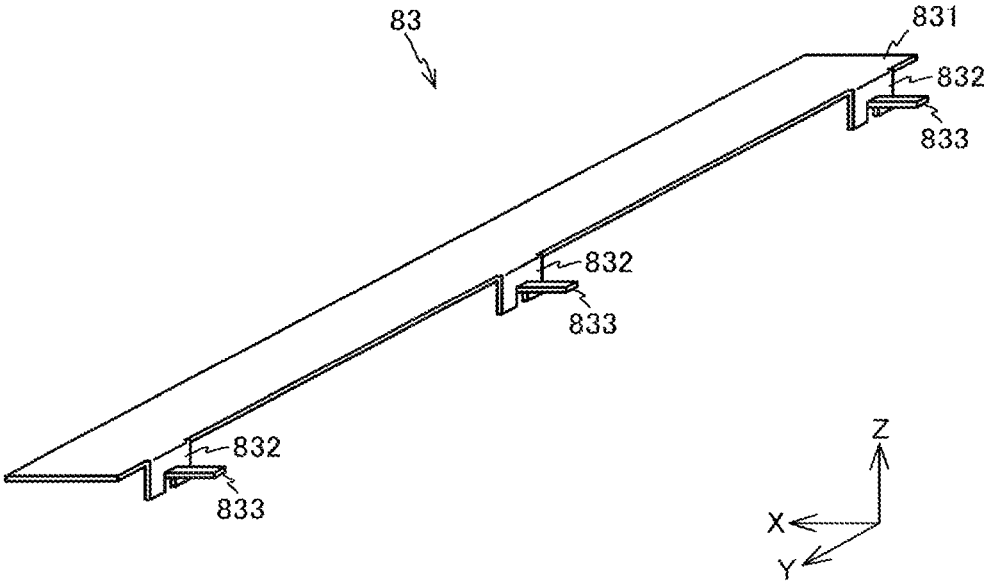
FIG. 8 is a perspective view of a support plate.

FIG. 8 is a perspective view of the support plate 83. The support plate 83 is, for example, a member formed of an iron or a stainless steel plate and has a longitudinal direction as the Y-axis direction. The support plate 83 has a main body portion 831 parallel to the XY plane, and three J-shaped claw portions 832 extending vertically downward (in the −Z direction) from the −X side end of the main body portion 831. Further, in the claw portion 832, a rectangular plate-like protruding portion 833 extending in the −X direction is formed. The length of the protruding portion 833 in the X-axis direction is adjusted to be longer than the natural length of the spring 84. The support plate 83 having the above-described configuration can be integrally formed by, for example, sheet-processing an iron or stainless steel plate.

As shown in FIG. 3, the support plate 83 is fixed to the lower surface of the base member 80. The spring 84 is attached to the support plate 83. The spring 84 is attached to the support plate 83 by fixing the +X side end portion to the claw portion 832 in a state where the protruding portion 833 is inserted. The contact portion 72 formed on the magnetic shunt member 70 is biased by the spring 84 in the −X direction. Thus, the magnetic shunt member 70 is pressed against the inner peripheral surface of the fixing belt 51 on the −X side.

In addition, when the support plate 83 is fixed to the lower surface of the base member 80, the protruding portions 833 of the support plate 83 penetrate the openings 72*a* provided in the contact portions 72 of the magnetic shunt member 70. Thus, the spring 84 is prevented from falling off.

Although the fixing belt 51 is shaped into a cylindrical shape, the XZ cross-sectional shape does not become a perfect circle due to the influence of the flexibility and viscoelasticity of the fixing belt 51 and the pressure roller 52 being pressed. Therefore, when the fixing belt 51 rotates, the magnetic shunt member 70 slides along the inner peripheral surface of the fixing belt 51 and oscillates about the fulcrum of the support member 82. Thus, the state where the magnetic shunt member 70 and the fixing belt 51 are in close contact is maintained.

The heating coil 60 is disposed along the outer peripheral surface of the fixing belt 51. The heating coil 60 faces the magnetic shunt member 70 via the fixing belt 51. A high-frequency voltage is applied to the heating coil 60 by a fixing control circuit 150 described later. When a high-frequency voltage is applied to the heating coil 60, an eddy current flows to the fixing belt 51 by electromagnetic induction, and the fixing belt 51 generates heat. The fixing belt 51 is heated to a temperature of 130° C. to 170° C.

The thermostat 90 is a cylindrical sensor having a contact point that is operated when heated to a predetermined temperature. The thermostat 90 is supported by, for example, a cylindrical cylinder 91 so as to be able to move in and out with a predetermined stroke. The thermostat 90 is biased by a spring 92 provided inside the cylinder 91, and a temperature sensitive portion protrudes from the cylinder 91. The thermostat 90 is in a state where the temperature sensitive portion is pressed against the inner peripheral surface of the fixing belt 51 via the magnetic shunt member 70 by supporting the cylinder 91 with a support member (not shown).

As shown in FIG. 4, the sliding member 95 is a cylindrical member shaped similar to the thermostat 90. The sliding member 95 is made of, for example, iron or stainless steel. The sliding member 95 is supported by, for example, the cylindrical cylinder 91 so as to be able to move in and out with a predetermined stroke. The sliding member 95 is biased by a spring 96 provided inside the cylinder 91, and the tip end portion thereof protrudes from the cylinder 91. The thermostat 90 is in a state where the tip end portion is pressed against the inner peripheral surface of the fixing belt 51 via the magnetic shunt member 70 by supporting the cylinder 91 by a support member (not shown).

As described above, the thermostat 90 and the sliding member 95 are pressed against the magnetic shunt member 70 by the springs (elastic bodies) 92 and 96. Therefore, by the rotation of the fixing belt 51, even when the magnetic shunt member 70 oscillates, the contact between the thermostat 90 and the sliding member 95, and the magnetic shunt member 70 is maintained.

Figure 9:
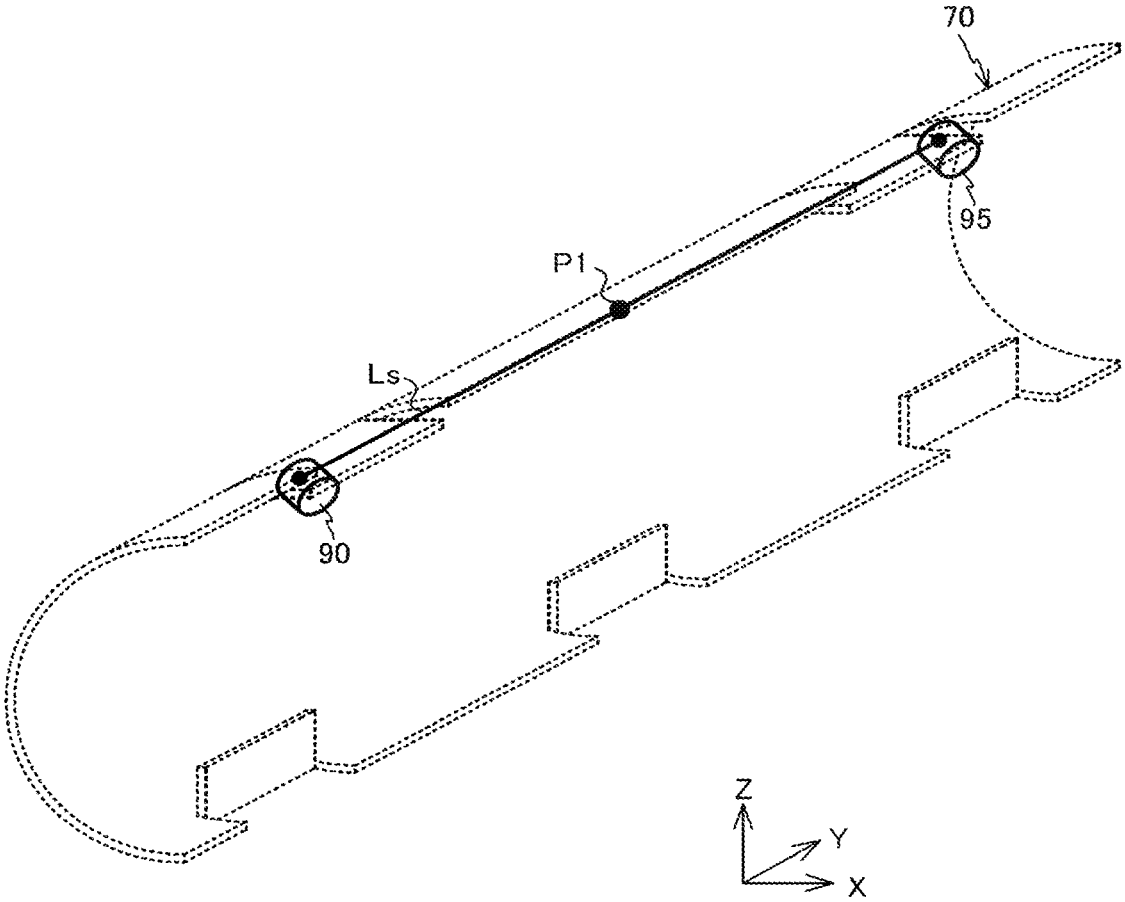
FIG. 9 is a perspective view showing a positional relationship between a thermostat and a sliding member with respect to the magnetic shunt member.

FIG. 9 is a perspective view showing the positional relationship between the thermostat 90 and the sliding member 95 with respect to the magnetic shunt member 70. As shown in FIG. 9, the thermostat 90 and the sliding member 95, which are disposed in a state of being pressed against the magnetic shunt member 70, are disposed to be separated from each other in the Y-axis direction. In addition, the shape of the sliding member 95 is formed such that the area of the temperature sensitive portion of the thermostat 90 in contact with the magnetic shunt member is equal to the area of the contact surface of the sliding member 95.

Figure 10:
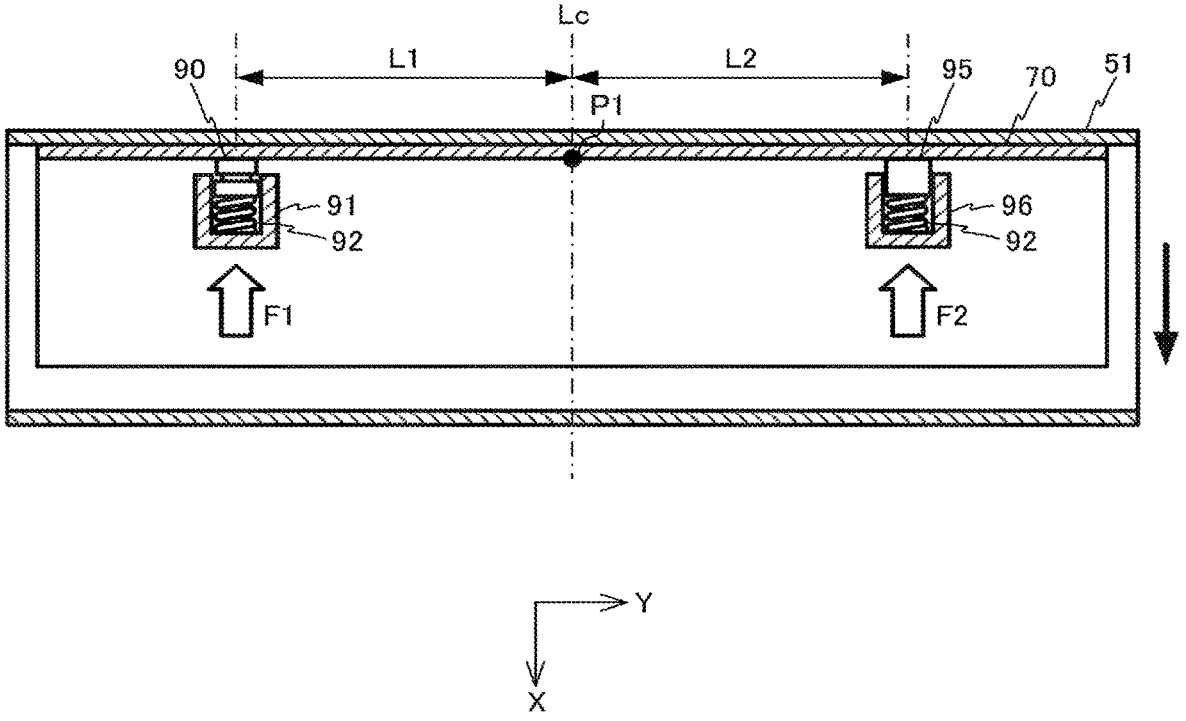
FIG. 10 is a view showing a cross section AA of the fixing belt and the magnetic shunt member in FIG. 3.

FIG. 10 is a view showing an AA cross section of the fixing belt 51 and the magnetic shunt member 70 in FIG. 3. A center line Lc indicated by a virtual line in the drawing passes through the center of the magnetic shunt member 70 and is parallel to the X axis. As shown in FIG. 10, the thermostat 90 is disposed at the position separated by a distance L1 from the center of the magnetic shunt member 70 in the longitudinal direction of the fixing belt 51, that is, in the Y-axis direction. In addition, the sliding member 95 is disposed at the position separated by a distance L2 in the Y-axis direction from the center of the magnetic shunt member 70. In the embodiment, the distance L1 is equal to the distance L2.

The thermostat 90 and the sliding member 95 are pressed against the fixing belt 51 by the springs 92 and 96 with elastic forces F1 and F2, respectively, via magnetic shunt member 70. In the fixing device 50, the spring 92 and spring 96 have the same natural length and spring constant, and the magnitude of the elastic force F1 is equal to the magnitude of the elastic force F2.

Returning to FIG. 3, the pressure roller 52 is a cylindrical member whose longitudinal direction is the Y-axis direction. The pressure roller 52 includes a core 52*a* made of a metal such as aluminum and a silicone rubber layer 52*b* laminated on the outer peripheral surface of the core. The surface of the silicone rubber layer 52*b* is coated with a PFA resin (perfluoroalkoxy fluorine resin). The outer diameter of the pressure roller 52 is about 25 mm and the length thereof is approximately equal to the length of the fixing belt 51. The pressure roller 52 is biased by an elastic member (not shown) in the direction toward the fixing belt 51 (−X direction). As a result, the pressure roller 52 is pressed against the pressure pad 81 via the fixing belt 51. The surface of the pressure roller 52 is in close contact with the surface of the fixing belt 51, and a nip through which the paper P passes from the lower side to the upper side (+Z direction) is formed.

In the fixing device 50 configured as described above, as the pressure roller 52 rotates, the paper P passes through the nip between the pressure roller 52 and the fixing belt 51, which respectively rotate in the direction indicated by the arrow in FIG. 3. As a result, the paper P is heated by the heated fixing belt 51, and the toner image formed on the paper P is fixed to the paper P.

When the fixing belt 51 rotates, the magnetic shunt member 70 pressed against the inner peripheral surface of the fixing belt 51 by the spring 84 slides with respect to the fixing belt 51. In the fixing device 50, as shown in FIG. 10, the thermostat 90 and the sliding member 95 are pressed against the fixing belt 51 via the magnetic shunt member 70. Therefore, when the magnetic shunt member 70 slides with respect to the fixing belt 51, the rotation moment M1 by the contact of the thermostat 90 and the rotation moment M2 by the contact of the sliding member 95 act on the magnetic shunt member 70. The rotation moment M1 is shown by the following equation (1), and the rotation moment M2 is shown by the following equation (2).

The coefficient α is a coefficient determined by the frictional resistance between the magnetic shunt member 70 and the fixing belt 51 and the viscous resistance of the oil applied to the inner peripheral surface of the fixing belt 51.

$$M1=L1\cdot\alpha F1 \quad (1)$$

$$M2=L2\cdot\alpha F2 \quad (2)$$

As described above, the distance L1 from the center line Lc of the magnetic shunt member 70 in the Y-axis direction is equal to the distance L2, and the elastic force F1 is equal to the elastic force F2. Therefore, when the product of the distance L1 and the elastic force F1 is equal to the product of the distance L2 and the elastic force F2, the rotation moment M1 and the rotation moment M2 acting on the central point P1 of the magnetic shunt member 70 have the magnitudes that are equal to each other. Here, as shown in FIG. 9, the central point P1 of the magnetic shunt member 70 is a middle point of the line Ls connecting the contact point of the thermostat 90 and the magnetic shunt member 70, and the contact point of the sliding member 95 and the magnetic shunt member 70.

When the magnitudes of the rotation moment M1 and the rotation moment M2 are the same, a force acts on the magnetic shunt member 70 to rotate the magnetic shunt member 70 around the Y-axis together with the fixing belt 51, but no rotating force acts on the point P1 to rotate the magnetic shunt member 70.

Figure 11:
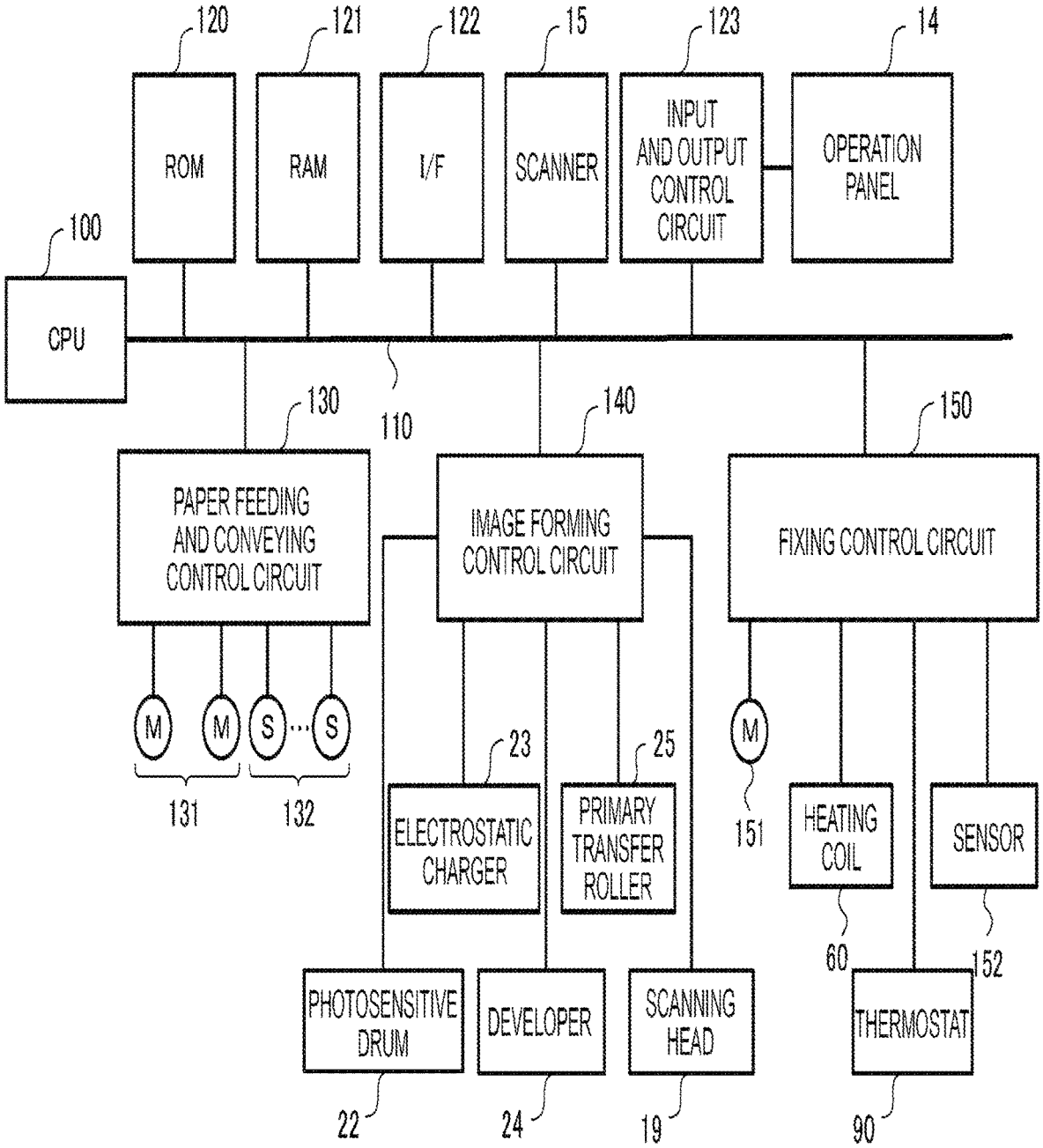
FIG. 11 is a block diagram of a control system that constitutes the image forming apparatus.

FIG. 11 is a block diagram of the control system that configures the image forming apparatus 10. The control system includes, for example, a CPU 100 which controls the entire image forming apparatus, a bus line 110, a read only memory (ROM) 120, a random access memory (RAM) 121, an interface 122, a scanner 15, an input and output control circuit 123, a paper feeding and conveying control circuit 130, an image forming control circuit 140, and a fixing control circuit 150. The CPU 100 and each circuit are connected via the bus line 110.

The ROM 120 stores control programs and control data that define basic operations of the image forming process.

The RAM 121 functions as a working memory which is a work area of the CPU 100.

The CPU 100 executes the program stored in the ROM 120. Thus, the respective components of the image forming apparatus 10 are controlled by the CPU 100 in an integrated manner, and processing for forming an image on a sheet is sequentially executed.

The interface 122 communicates with a device such as a terminal used by the user. The input and output control circuit 123 displays information on the operation panel 14 and receives the input from the operation panel 14. The user of the image forming apparatus 10 can specify, for example, the paper size, the number of copies of the original document, and the like by operating the operation panel 14.

The paper feeding and conveying control circuit 130 is a unit that controls a motor group 131 which drives the pickup roller 18*a*, the paper feeding roller 35, or the paper discharge roller 37 in the conveyance path. The paper feeding and conveying control circuit 130 controls the motor group 131 according to the control signal from the CPU 100 and the detection results of various sensors 132 provided in the vicinity of the paper feeding cassette 18 or in the conveyance path or the like.

The image forming control circuit 140 controls the photosensitive drum 22, the electrostatic charger 23, the scanning heads 19Y, 19M, 19C, and 19K, the developer 24, and the primary transfer roller 25, respectively, based on the control signal from the CPU 100.

The fixing control circuit 150 controls a drive motor 151 that rotates the pressure roller 52 of the fixing device 50 based on the control signal from the CPU 100. In addition, the fixing control circuit 150 drives the heating coil 60 based on the output from the sensor 152 for detecting the temperature of the fixing belt 51, the size of the paper P notified from the CPU, and the like. The fixing control circuit 150 stops the driving of heating coil 60 in response to the operation of thermostat 90.

In the image forming apparatus 10, an image forming process for printing on the paper P is performed with a print command from the user as a trigger. The image forming process is performed, for example, when image data received via the interface 122 is printed or when image data generated by the scanner 15 is printed.

Next, the image forming process of the image forming apparatus 10 will be described. The image forming apparatus 10 executes the image forming process for forming an image on the paper P when a print command is received from a user. In the image forming process, as shown in FIG. 1, the paper P is pulled out from the paper feeding cassette 18 by the pickup roller 18*a* and conveyed by the paper feeding roller 35 between the intermediate transfer belt 21 and the secondary transfer roller 33.

In parallel with the above-mentioned operation, in the image forming units 20Y, 20M, 20C, and 20K, toner images are formed on the photosensitive drums 22, respectively. The toner image formed on the photosensitive drums 22 of the respective image forming units 20Y, 20M, 20C, and 20K are sequentially transferred to the intermediate transfer belt 21. As a result, a toner image formed by a yellow (Y) toner, a magenta (M) toner, a cyan (C) toner, and a black (K) toner is formed on the intermediate transfer belt 21.

When the paper P conveyed between the intermediate transfer belt 21 and the secondary transfer roller 33 passes through the intermediate transfer belt 21 and the secondary transfer roller 33, the toner image formed on the intermediate transfer belt 21 is transferred to the paper P. As a result, a toner image formed by toners of yellow (Y), magenta (M), cyan (C) and black (K) is formed on the paper P.

The paper P on which the toner image is formed passes through the fixing device 50. At this time, the fixing control circuit 150 controls the output of the heating coil 60 in accordance with the size of the paper P. The paper P is heated bypassing through the fixing device 50. As a result, the toner image transferred onto the paper P is fixed to the paper P, and the image is formed on the paper P. The paper P on which the image is formed is discharged by the paper discharge roller 37 to the paper discharge unit 38. In the image forming process, the above-mentioned processing is performed several numbers of times according to the number of copies.

As described above, in the fixing device 50 according to the embodiment, as shown in FIG. 10, when the thermostat 90 pressed against the fixing belt 51 via the magnetic shunt member 70 is disposed at a position offset from the center line Lc in the Y-axis direction, the sliding member 95 pressed against the fixing belt 51 via the magnetic shunt member 70 is disposed symmetrically with respect to the thermostat 90 based on the point P1. Also, the thermostat 90 and the sliding member 95 are pressed against the fixing belt 51 by the springs 92 and 96 respectively with the equal elastic force.

Therefore, the rotation moment M1 generated by the pressing of the thermostat 90 and the rotation moment M2 generated by the pressing of the sliding member 95 are mutually canceled, and the rotation of the magnetic shunt member 70 around the point P1 is suppressed. As a result, the posture of the magnetic shunt member 70 with respect to the fixing belt 51 can be maintained constantly. Therefore, the thermostat 90, the magnetic shunt member 70 and the fixing belt 51 are maintained in a state of being in close contact with each other.

For example, when the thermostat 90 is placed at a position offset from the center line Lc in the Y-axis direction, if the sliding member 95 is not disposed, a rotation moment occurs around the point P1 or the vicinity thereof. Since the magnetic shunt member 70 is supported so as to oscillate about the virtual axis S shown in FIG. 7, there is some play (clearance) between the inner wall surface of the opening 71*a* of the magnetic shunt member 70 and the protruding portion 822*a* of the support member 82. Therefore, when the rotation moment acts on the magnetic shunt member 70, the magnetic shunt member 70 rotates and tilts about the axis perpendicular to the inner peripheral surface of the fixing belt 51 with respect to the fixing belt 51 retained horizontally. In this case, the magnetic shunt member 70 and the fixing belt 51 may be separated from each other.

In this embodiment, the rotation moment M1 generated by the pressing of the thermostat 90 and the rotation moment M2 generated by the pressing of the sliding member 95 are mutually canceled, and the inclination of the magnetic shunt member 70 with respect to the fixing belt 51 is suppressed. Therefore, the thermostat 90, the magnetic shunt member 70 and the fixing belt 51 are maintained in a state of being in close contact with each other.

When the thermostat 90, the magnetic shunt member 70 and the fixing belt 51 are maintained in a state of being in close contact with each other, when the fixing belt 51 is heated by the heating coil 60, the heat of the fixing belt 51 is efficiently transmitted to the thermostat 90 via the magnetic shunt member 70. Therefore, it is possible to detect overheat of the fixing belt 51 without any leak.

Also, when the heating coil 60 is driven, the magnetic shunt member 70 also generates heat by itself. In this case, when the magnetic shunt member 70 and the fixing belt 51 are separated from each other, the heat transfer between the magnetic shunt member 70 and the fixing belt 51 is inhibited. Therefore, even when the temperature of the fixing belt 51 is low, the magnetic shunt member 70 may be overheated and thermostat 90 may malfunction. In the embodiment, the state in which the magnetic shunt member 70 and the fixing belt 51 are in close contact with each other is maintained. Therefore, the heat from the magnetic shunt member 70, whose temperature is increased by self-heating or the like, is efficiently transferred to the fixing belt 51 which is cooled by heating the paper P. Therefore, the malfunction of the thermostat 90 is suppressed.

When the magnetic shunt member 70 is inclined with respect to the fixing belt 51, it is considered that the wear of the contact point between the magnetic shunt member 70 and one of the support members 82 of the pair of support members 82 rapidly progresses. In the fixing device 50 according to the embodiment, it is possible to suppress the one-side wear and to expand the life of the apparatus.

The thermostat 90 may be used to detect overheating of the apparatus, which may result in a serious accident. In this case, when the thermostat 90 is operated and the image forming apparatus 10 is stopped, the image forming apparatus 10 cannot be activated until the serviceman inspects the image forming apparatus 10 or replaces the fixing device 50. In the fixing device 50 according to the embodiment, since the malfunction of the thermostat 90 is suppressed, the unnecessary stopping of the image forming apparatus 10 can be avoided.

The image forming apparatus 10 according to the embodiment includes the fixing device 50. Therefore, it is possible to form an image continuously and accurately while suppressing unnecessary stopping of the image forming apparatus 10.

Figure 12:
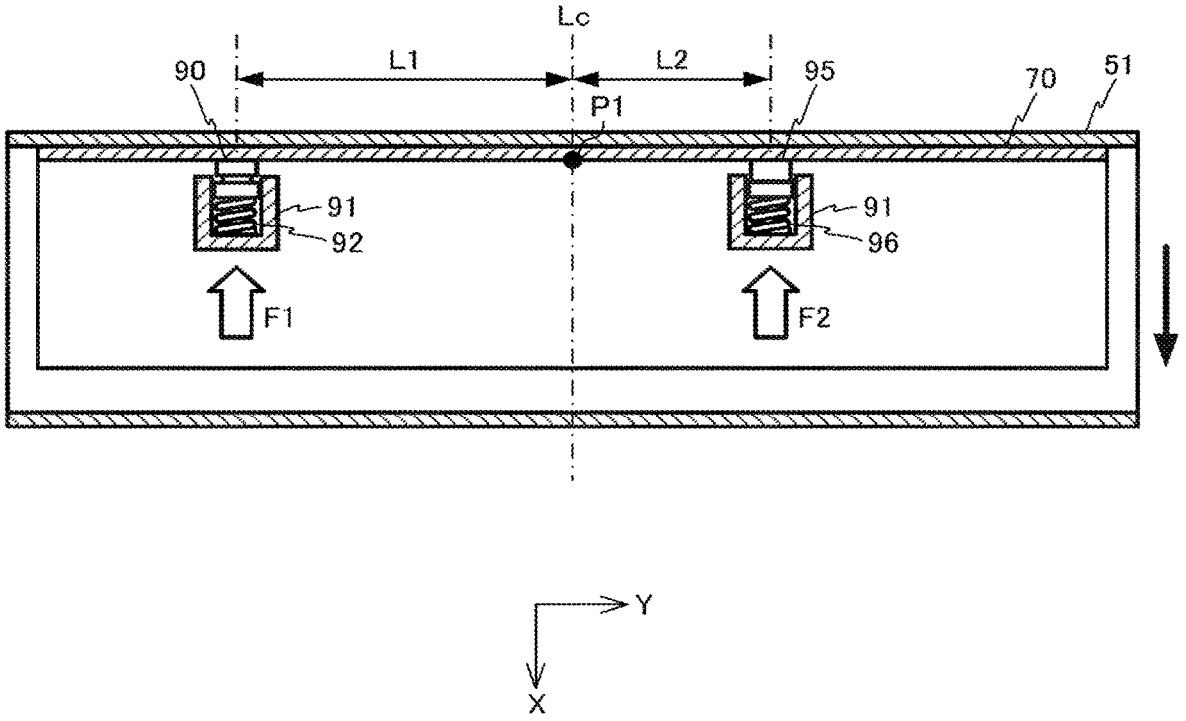
FIG. 12 is a view showing a modification example of the fixing device.

As described above, the embodiments are described, and the disclosure is not limited by the above-mentioned embodiments. For example, in the above-mentioned embodiment, as shown in FIG. 10, the case where the distance L1 from the point P1 to the thermostat 90 and the distance L2 from the point P1 to the sliding member 95 are equal is described. However, the case is not limited thereto, as one example, as shown in FIG. 12, when the thermostat 90 and the sliding member 95 are disposed with the point P1 sandwiched therebetween, the distance L1 may not be equal to the distance L2. In this case, as shown in the following equation (3), the elastic modulus of springs 92 and 96 is adjusted so as to equalize the product of the elastic force F1 of the spring 92 and the distance L1, and the product of the elastic force F2 of the spring 96 and the distance L2. Even in this case, the rotation moment M1 generated by pressing the thermostat 90 and the rotation moment M2 generated by pressing the sliding member 95 are mutually canceled, and the inclination of the magnetic shunt member 70 with respect to the fixing belt 51 is suppressed. Therefore, the thermostat 90, the magnetic shunt member 70 and the fixing belt 51 are maintained in a state of being in close contact with each other.

$$L1 \cdot F1 = L2 \cdot F2 \quad (3)$$

In the embodiment, the case where the thermostat 90 as a sensor is pressed against the fixing belt 51 is described. The above-mentioned sensor is not limited to the thermostat 90, but may be a temperature sensor.

In the embodiment, the case where the magnetic shunt member 70 is pressed by the spring 96 via the sliding member 95 is described. The case is not limited thereto, but the magnetic shunt member 70 may be pressed directly by the spring 96.

In the embodiment, the fixing belt 51 is heated by using electromagnetic induction by the heating coil 60. However, the heating is not limited thereto, but the fixing belt 51 may be heated by using a halogen heater or a ceramic heater. In this case, the magnetic shunt member 70 can be used as a heat storage member for increasing the heat capacity of the fixing belt 51. As the heat storage member, for example, a metal, gel having a heat storage property molded with a metal, or the like can be considered.

Figure 13:
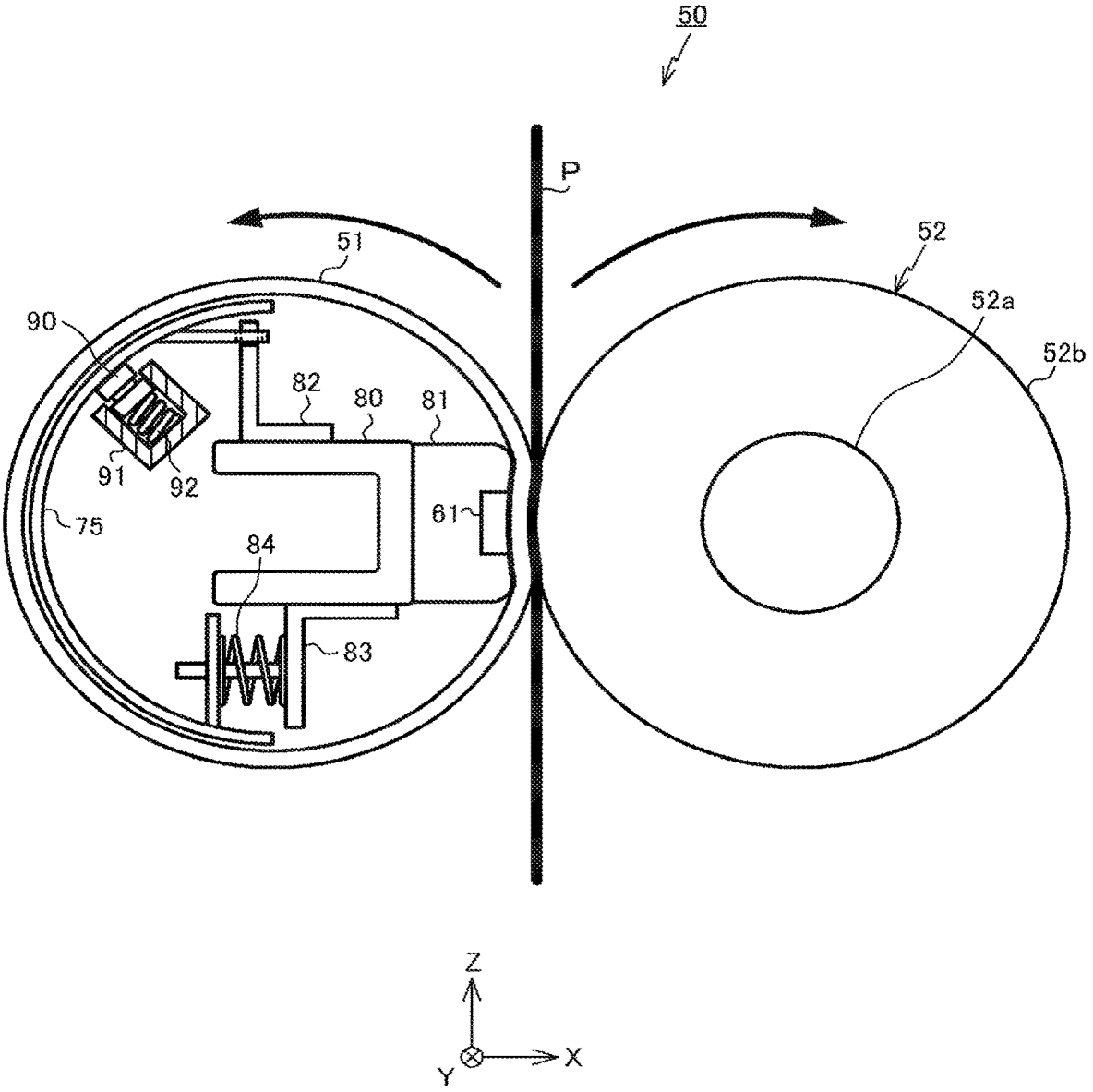
FIG. 13 is a view showing a modification example of the fixing device.

FIG. 13 is a view showing the fixing device 50 using a method of heating the paper P by a heater 61 via the film-like fixing belt 51 as one example. The heater 61 includes, for example, a substrate made of ceramic and a heating unit formed on the substrate. In the fixing device 50, the heater 61 heats the paper P by applying heat to the paper P via the fixing belt 51. In this case, the temperature of the fixing belt 51 can be maintained by using, for example, an auxiliary heating member 75 made of a material having a high heat storage effect instead of the magnetic shunt member 70.

In the embodiment, the case where the image forming apparatus 10 is a multifunction peripheral is described. The image forming apparatus is not limited thereto, but the image forming apparatus 10 may be a laser printer or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device that fixes a toner image to a medium, comprising:

a heating body rotatably supported;

an auxiliary heating member disposed along a portion of an inner surface of the heating body;

a temperature sensor facing toward the auxiliary heating member;

a first elastic body configured to provide a first elastic force to press the temperature sensor toward the auxiliary heating member; and a second elastic body, separated from the first elastic body, configured to sandwich a center of the auxiliary heating member with respect to the temperature sensor in a longitudinal direction of the heating rotation body, and provide a second elastic force to press a sliding member toward the auxiliary heating member, wherein a product of a first distance from the center of the auxiliary heating member to the first elastic body and the first elastic force is equal to a product of a second distance from the center of the auxiliary heating member to the second elastic body and the second elastic force, wherein the sliding member is provided between the second elastic body and the auxiliary heating member, an area of the sliding member in contact with the auxiliary heating member equal to an area of the temperature sensor in contact with the auxiliary heating member.

2. The device according to claim 1, wherein the first distance is equal to the second distance.

3. The device according to claim 2, wherein an elastic modulus of the first elastic body is equal to an elastic modulus of the second elastic body.

4. The device according to claim 2, wherein the first elastic body and the second elastic body are springs having the same spring constant.

5. The device according to claim 1, wherein the temperature sensor is a thermostat.

6. The device according to claim 1, further comprising:

a heating coil, disposed along a portion of an outer surface of the heating body, that is configured to heat the heating body.

7. The device according to claim 1, wherein the auxiliary heating member is curved along the inner surface of the heating body.

8. The device according to claim 1, wherein the auxiliary heating member is configured to move with a movement of the heating body.

9. The device according to claim 8, wherein
at least one end portion of the auxiliary heating member is pivotally supported.

10. The device according to claim 8, wherein
the heating body is horizontally supported, and
an upper end portion of the auxiliary heating member is pivotally supported.

11. The device according to claim 1, wherein
the auxiliary heating member is a heat storage member made of a metal material.

12. The device according to claim 1, wherein
the auxiliary heating member is formed of a magnetic shunt member.

13. An image forming apparatus comprising:
a transfer body configured to transfer a toner image to a medium;
a toner image forming device configured to form the toner image on the transfer body; and
a fixing device configured to heat the medium to which the toner image is transferred by the transfer body, and fix the toner image to the medium, wherein
the fixing device includes:
a heating body rotatably supported;
an auxiliary heating member disposed along a portion of an inner surface of the heating body;
a temperature sensor facing toward the auxiliary heating member;
a first elastic body configured to provide a first elastic force to press the temperature sensor toward the auxiliary heating member; and
a second elastic body, separated from the first elastic body, configured to sandwich a center of the auxiliary heating member with respect to the temperature sensor in a longitudinal direction of the heating rotation body, and provide a second elastic force to press a sliding member toward the auxiliary heating member,
wherein a product of a first distance from the center of the auxiliary heating member to the first elastic body and the first elastic force is equal to a product of a second distance from the center of the auxiliary heating member to the second elastic body and the second elastic force,
wherein the sliding member is provided between the second elastic body and the auxiliary heating member, an area of the sliding member in contact with the auxiliary heating member equal to an area of the temperature sensor in contact with the auxiliary heating member.

14. A fixing device that fixes a toner image to a medium, comprising:
a heating body rotatably supported;
an auxiliary heating member disposed along a portion of an inner surface of the heating body;
a temperature sensor facing toward the auxiliary heating member;
a first elastic body configured to provide a first elastic force to press the temperature sensor toward the auxiliary heating member; and
a second elastic body, separated from the first elastic body, configured to sandwich a center of the auxiliary heating member with respect to the temperature sensor in a longitudinal direction of the heating rotation body, and provide a second elastic force to press a sliding member toward the auxiliary heating member disposed between the sliding member,
wherein a product of a first distance from the center of the auxiliary heating member to the first elastic body and the first elastic force is equal to a product of a second distance from the center of the auxiliary heating member to the second elastic body and the second elastic force,
wherein the first distance is equal to the second distance, and
wherein the first elastic body and the second elastic body are made of rubber having the same elastic constant.

15. The device according to claim 14, wherein
an elastic modulus of the first elastic body is equal to an elastic modulus of the second elastic body.

16. The device according to claim 14, wherein
the first elastic body and the second elastic body are springs having the same spring constant.

17. The device according to claim 14, further comprising:
a heating coil, disposed along a portion of an outer surface of the heating body, that is configured to heat the heating body.

18. A fixing device that fixes a toner image to a medium, comprising:
a heating body rotatably supported;
an auxiliary heating member disposed along a portion of an inner surface of the heating body;
a temperature sensor facing toward the auxiliary heating member;
a first elastic body configured to provide a first elastic force to press the temperature sensor toward the auxiliary heating member; and
a second elastic body, separated from the first elastic body, configured to sandwich a center of the auxiliary heating member with respect to the temperature sensor in a longitudinal direction of the heating rotation body, and provide a second elastic force to press a sliding member toward the auxiliary heating member,
wherein a product of a first distance from the center of the auxiliary heating member to the first elastic body and the first elastic force is equal to a product of a second distance from the center of the auxiliary heating member to the second elastic body and the second elastic force,
wherein the first elastic body and the second elastic body are made of rubber having the same elastic constant.

* * * * *